US008382025B2

(12) United States Patent
Müller

(10) Patent No.: US 8,382,025 B2
(45) Date of Patent: Feb. 26, 2013

(54) METHOD AND DEVICE FOR CONNECTING TWO MATERIAL WEBS

(75) Inventor: Freddy Müller, Bischofswerda (DE)

(73) Assignee: Siemens Aktiengesellschaft, München (DE)

( * ) Notice: Subject to any disclaimer, the term of this patent is extended or adjusted under 35 U.S.C. 154(b) by 404 days.

(21) Appl. No.: 12/310,927

(22) PCT Filed: Aug. 21, 2007

(86) PCT No.: PCT/EP2007/058641

§ 371 (c)(1),
(2), (4) Date: Dec. 23, 2009

(87) PCT Pub. No.: WO2008/031692

PCT Pub. Date: Mar. 20, 2008

(65) Prior Publication Data

US 2010/0090052 A1 Apr. 15, 2010

(30) Foreign Application Priority Data

Sep. 12, 2006 (DE) ..... 10 2006 042 728

(51) Int. Cl.
*B65H 19/14* (2006.01)

(52) U.S. Cl. ..... 242/554.1; 242/554.4; 242/555.3

(58) Field of Classification Search ..... 242/554.1, 242/554.4, 555.3

See application file for complete search history.

(56) References Cited

U.S. PATENT DOCUMENTS

| | | | | |
|---|---|---|---|---|
| 3,391,877 | A | 7/1968 | Angell et al. | |
| 4,043,520 | A | 8/1977 | Olsson et al. | |
| 4,492,609 | A * | 1/1985 | Blom | 156/507 |
| 4,564,149 | A * | 1/1986 | Barzano' | 242/554.1 |
| 5,360,181 | A * | 11/1994 | Hayashi et al. | 242/555.6 |
| 7,201,345 | B2 * | 4/2007 | Werner et al. | 242/554.2 |

FOREIGN PATENT DOCUMENTS

| | | | |
|---|---|---|---|
| DE | 1 157 241 | B | 11/1963 |
| DE | 1 932 621 | A1 | 1/1970 |
| DE | 21 33 988 | A1 | 1/1973 |
| DE | 39 27 172 | A1 | 2/1991 |
| GB | 473 712 | A | 10/1937 |
| JP | 5286615 | A | 11/1993 |
| JP | 2006188348 | A | 7/2006 |

OTHER PUBLICATIONS

Communication From Japanese Patent Office, Mar. 21, 2012, pp. 1-3.

* cited by examiner

*Primary Examiner* — Sang Kim

(57) ABSTRACT

A method and a corresponding apparatus for connecting two material webs which are pulled off from an old and a new reel are specified, wherein each reel is driven and wherein the splicing takes place while both reels are in motion. One position of all units participating in the splicing operation is regulated as a function of a position of the new reel, by a position of an adhesive point which is applied to the new reel being detected for this purpose.

5 Claims, 2 Drawing Sheets

METHOD AND DEVICE FOR CONNECTING TWO MATERIAL WEBS

CROSS REFERENCE TO RELATED APPLICATIONS

This application is the US National Stage of International Application No. PCT/EP2007/058641 filed Aug. 21, 2007 and claims the benefit thereof. The International Application claims the benefits of German patent application No. 10 2006 042 728.9 DE filed Sep. 12, 2006, both of the applications are incorporated by reference herein in their entirety.

FIELD OF INVENTION

The invention relates to a method and a corresponding device for connecting two material webs that are withdrawn or withdrawable in each case from an old and a new reel. Each reel is driven indirectly or directly or drivable indirectly or directly. The connecting of the two material webs occurs while both reels are in motion, i.e. being driven. The term that is used conventionally, and is accordingly used here and in the following, for such a connecting of two material webs is "splicing".

BACKGROUND OF INVENTION

A special form of splicing is the so-called "flying splice", whereby two material webs are connected at full processing speed and corresponding rotational speed of the reels involved, i.e. the old and the new reels. If a reel is being unwound continuously in the course of a production process and is running out, a material web that is withdrawable or withdrawn from the new reel is spliced by means of a flying splice at full speed onto the material web withdrawn from the old reel. The material feed may then continue uninterrupted to a downstream installation, for example a packaging installation or the like. During splicing it is necessary to activate various elements that are involved in the splicing operation. The elements involved in the splicing operation include first of all a press-on roller, which presses the new material web onto the old material web, and a cutting knife, which separates the old reel from the material web that arises after splicing.

In the prior art it is known to use, for a flying splice, speed-controlled drives for the individual elements involved in the splicing operation and depending upon a position of the new reel to activate the elements involved in the splicing operation for example by means of valves. Taking dead times of the valves into consideration, a starting time is calculated for the valves. In this case, the elements involved in the splicing operation are activated depending upon their respective speed. In this case, cycle times of the relevant automation directions and angular accuracy are crucial to the quality of the flying splice. Because of the considerable influence of the cycle times, mostly special and separate hardware is required. This results in additional cost and communication with the rest of the installation is not always guaranteed.

SUMMARY OF INVENTION

It is accordingly an object of the present invention to specify a method and a device of the previously described type, which avoids or at least reduces the effects of the drawbacks outlined above. In particular, the flying splice is to be carried out as precisely as possible even at higher speeds and the overlap between the two material webs is preferably to be kept small.

This object is achieved according to the invention by a method and a device as claimed in the claims. In addition, in the case of a method of connecting two material webs that are withdrawn or withdrawable in each case from an old and a new reel, the reels each being driven or drivable and the splicing occurring while both reels are being driven, it is provided that for splicing in each case a position of all of the units involved in the splicing operation is controlled depending upon a position of the new reel.

The advantage of the invention is above all that by virtue of position control of the elements involved in the splicing operation these elements may be activated independently of a speed of the new reel and above all independently of cycle times in the system. What is more, the elements involved in the splicing operation may be activated by means of electric motors and by means of the position control a synchronous operation may be produced, which guarantees incrementally precise placing of the cutting knife or the adhesive roller onto the new reel. In addition, there is no need for special hardware, which is required solely for control of the flying splice.

With regard to the device, the renamed object is achieved according to the invention by the features of the independent device claim.

The dependent claims are geared to preferred embodiments of the present invention.

References back used in sub-claims refer to the further development of the subject matter of the main claim by the features of the respective sub-claim; they are not to be understood as a waiver with regard to achieving independent item protection for the combination of features in the related sub-claims. Furthermore, with regard to an interpretation of the claims in the case of a more specific description of a feature in a subordinate claim, it is to be assumed that there is no such restriction in the, in each case, preceding claims.

Preferably, for determining the position of the new reel a position of an adhesive point, which is or may be provided on the new reel, is detected. After splicing has been carried out, the adhesive point defines the position of connection of the old and the new material web. In a corresponding manner the adhesive roller and the cutting knife have to go into action with regard to the adhesive point. Furthermore, if the adhesive point is situated in a position, in which the connecting of the old and the new material web is intended, the new reel itself has to be situated in a position that brings the old and the new material web into contact.

In a preferred embodiment of the invention it is provided that for splicing by means of a turnstile drive a turnstile, on both ends of which the first and the second reel are or may be mounted, is swiveled into a change position. At the latest in the change position the new reel is accelerated by means of a first drive up to a withdrawal speed, i.e. a speed of the material web running off the old reel. Then, depending upon the position of the adhesive point the turnstile is swiveled in a position-controlled manner by means of the turnstile drive in the direction of a splicing position and by means of an adhesive roller drive the adhesive roller is moved in the direction of a press-on position. Because of the position control it is then ensured that, when the adhesive point comes into contact with an old web running off the old reel, the adhesive roller is in the press-on position. Equally, because of the position control a cutting knife severs the old web after a defined or definable overrun.

The claims filed with the application are formulation proposals without prejudice as to the attainment of more extensive patent protection. The applicant reserves the right additionally to claim further feature combinations that have previously been disclosed only in the description and/or drawings.

The exemplary embodiment or any exemplary embodiment is not to be interpreted as a restriction of the invention. Rather, within the scope of the present disclosure many alterations and modifications are possible, in particular such variants, elements and combinations as are inferable, for example by combining or modifying individual features and/or elements or method steps that are described in connection with the general or specific description part and contained in the claims and/or the drawings, by the person skilled in the art with regard to achieving the object and by means of combinable features lead to a new subject matter or to new method steps and/or method step sequences, also insofar as they relate to manufacturing- and operating methods.

BRIEF DESCRIPTION OF THE DRAWINGS

There now follows a detailed description of an exemplary embodiment of the invention with reference to the drawings. In all of the figures, articles or elements that correspond to one another are provided with the same reference characters.

The drawings show

DETAILED DESCRIPTION OF INVENTION

Figure 1:
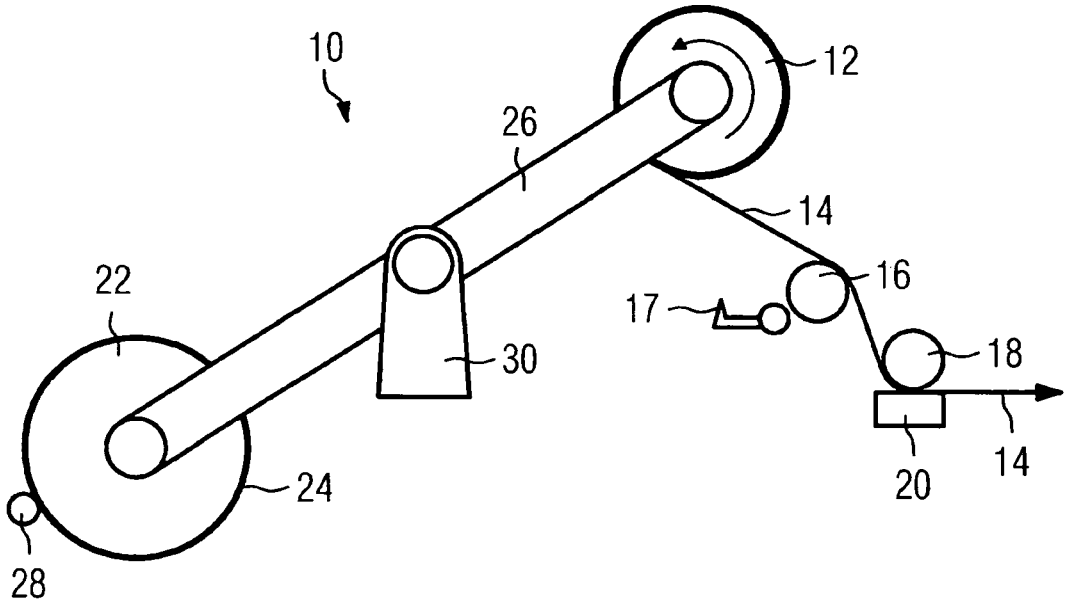
FIG. 1 a splicing device.

FIG. 1 shows a splicing device 10, in which a material web 14, which for the purpose of differentiation is referred to as old material web or in short as old web 14, is withdrawn from a reel, which likewise for the purpose of differentiation is referred to as old reel 12. The material web 14 runs over an adhesive roller 16, in the vicinity of which a cutting knife 17 is disposed, and a guide roller 18. In the region of the guide roller 18 a tension measuring device 20 is provided. On leaving the splicing device 10, the material web 14 is fed to an installation, for example a packaging installation, which is not represented. For splicing, i.e. for connecting the old web 14 running off the old reel to a new web 24 withdrawable from a new reel 22, the splicing device 10 comprises a turnstile 26, by means of which, when the old reel 12 is running out, the new reel 22 may be brought into the position of the old reel 12. As a sensor for determining a diameter either of the old or of the new reel 12, 22, a piecing tacho 28 is provided in the region of the neutral position of the new reel 22 that is represented in FIG. 1.

Figure 2:
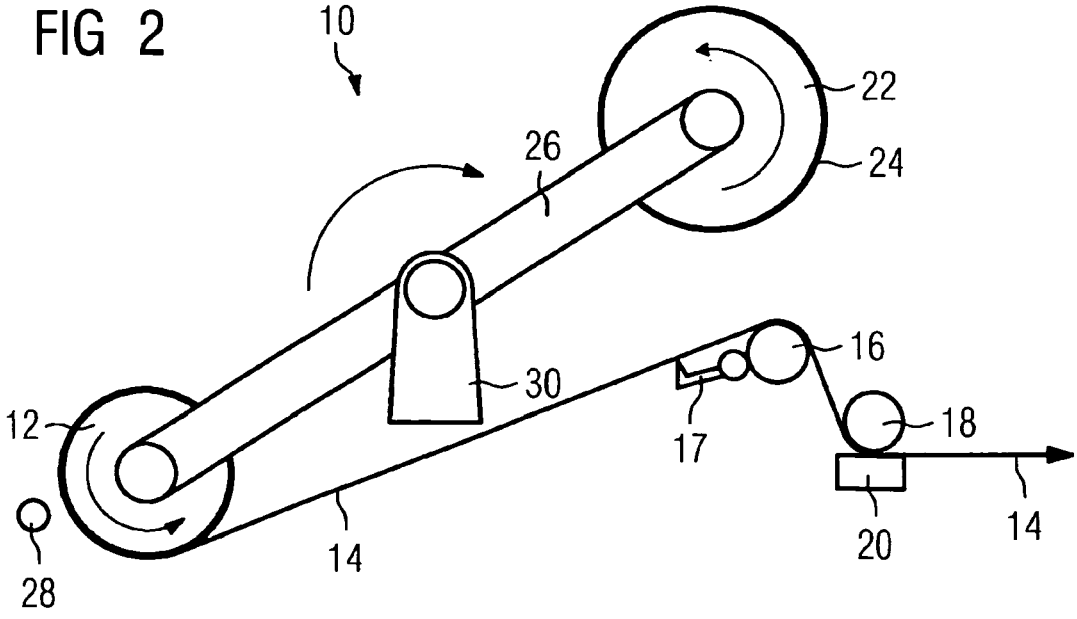
FIG. 2-FIG. 4 various snapshots during a splicing operation carried out by the splicing device.

FIG. 2 shows a snapshot, in which for splicing by means of a turnstile drive 30, which is associated with the turnstile 26, the turnstile 26, on both ends of which the first and the second reel 12, 22 are mounted, is swiveled into a change position. In the change position the new reel 22 is accelerated up to a withdrawal speed of the material web 14, i.e. a speed, at which the old web 14 is running off or being withdrawn from the old reel 12. With swiveling into the change position the new reel 22 is swiveled into the range of the adhesive roller 16 and the cutting knife 17. The old reel 12 is simultaneously moved into the region of the neutral position of the new reel 22.

Figure 3:
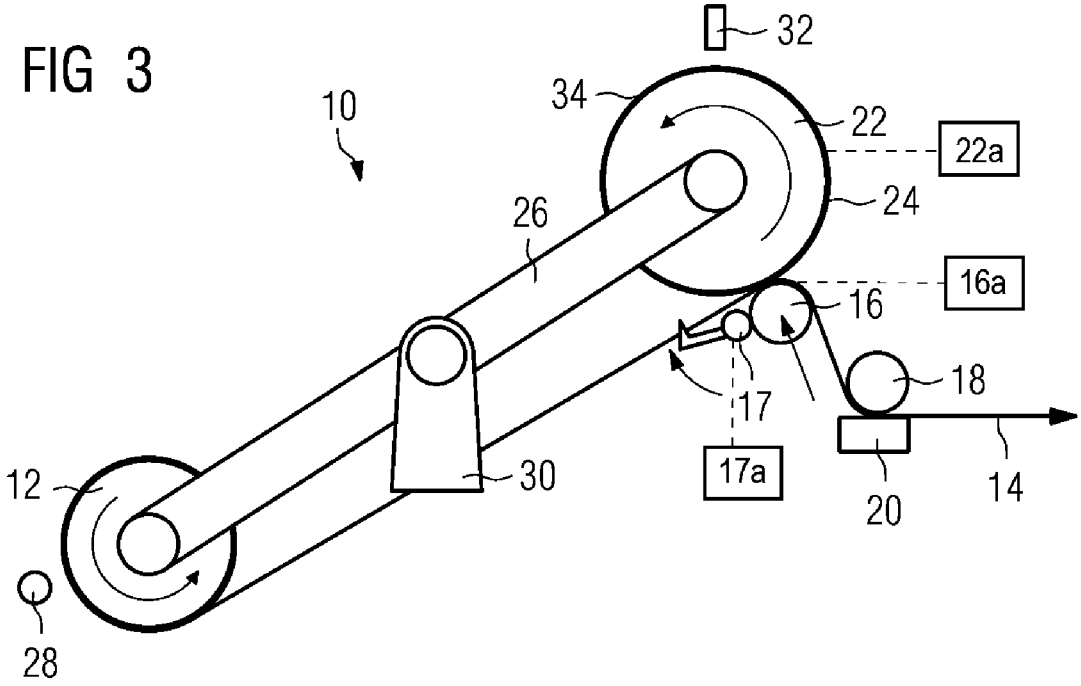
Figure 4:
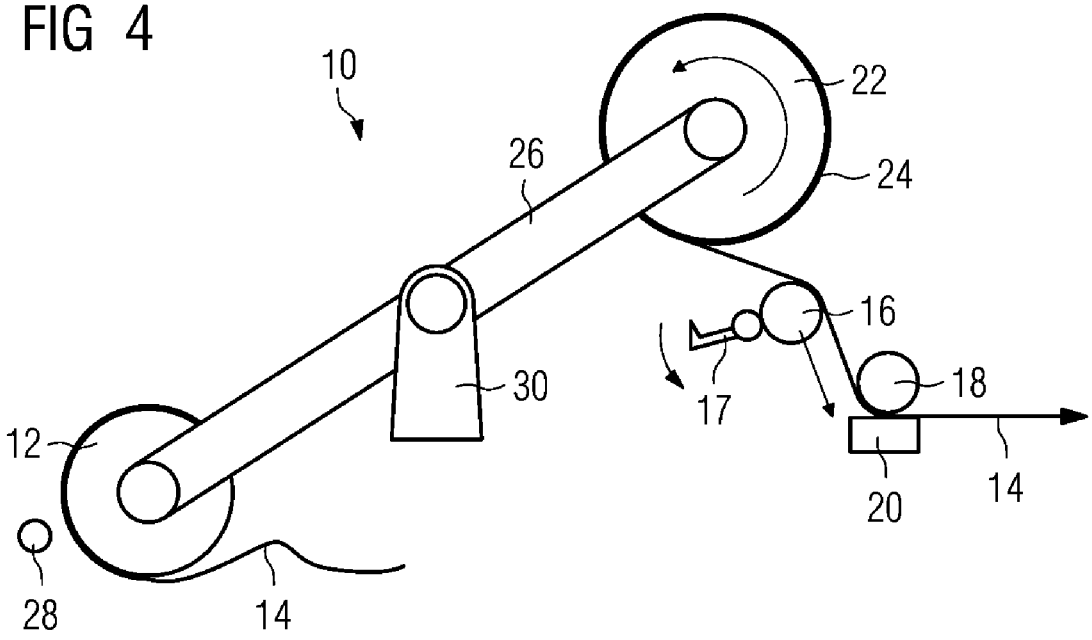

FIG. 3 shows how in the spatial vicinity of the new reel 22 in change position a sensor for adhesive point detection 32 is provided. This sensor 32 detects an adhesive point 34 that is provided on the outer circumference of the new reel 22. The units involved in the splicing operation, i.e. in particular a first drive 22*a* for the new reel 22, the turnstile drive 30 for the turnstile 26, an adhesive roller drive 16*a* for the adhesive roller 16 and a cutting knife drive 17*a* for the cutting knife 17, are controlled depending upon a position of the new reel 22. The drives 16*a*, 17*a* and 22*a* are only schematic representations. In the present case, for determining the position of the new reel 22 a position of the adhesive point 34 that is or may be provided on the new reel 22 is detected. Then, during splicing, depending upon the position of the adhesive point 34 the turnstile 26 is swiveled in a position-controlled manner by means of the turnstile drive 30 in the direction of a splicing position (FIG. 3). By means of the adhesive roller drive the adhesive roller 16 is then moved in the direction of a press-on position. Because of the position control in the present case three movements, namely the rotation of the new reel 22, on account of which the adhesive point 34 is moved in the direction of the press-on position, the rotation of the turnstile 26 and the driving of the adhesive roller 16, are coordinated in such a way that it is guaranteed that, when the adhesive point comes into contact with the old web 14 running off the old reel 12, the adhesive roller 16 is situated in the press-on position, i.e. a position, in which the adhesive roller 16 presses the old web 14 onto the outer circumference of the new reel 22 and in this case, as soon as the adhesive point 34 passes the press-on position, effects the connection of the new reel 22 to the old web 14. Because of the position control, after a defined or definable overrun a splicing knife 17 is activated, which after the splicing operation severs the old web 14. To conclude the splicing operation, as is represented in FIG. 4, with regard to the orientation of the turnstile 26 the alignment already represented in FIG. 2 is adopted once more. The material web 14 now runs off the new reel 22. The old reel may be stopped, in particular set to a so-called rapid stop, by means of a specially provided device, which is not represented. Adhesive roller 16 and splicing knife 17 are moreover moved into a neutral position.

The invention may therefore be summarized as follows: a method and a corresponding device for connecting two material webs that are withdrawn or withdrawable in each case from an old and a new reel 12, 22, each reel 12, 22 being driven or drivable and the splicing occurring while both reels 12, 22 are in motion, are specified, in which for splicing in each case a position of all of the units involved in the splicing operation is controlled depending upon a position of the new reel 22 in that for this purpose in particular a position of an adhesive point 34, which is or may be provided on the new reel 22, is detected.

The invention claimed is:

1. A method for connecting-splicing-two material webs that are withdrawn from an old reel and a new reel, each reel being driven, comprising:

providing a new reel, an old reel, a new material web, and an old material web;

detecting a position of an adhesive point provided on the new reel for determining the position of the new reel;

swiveling a turnstile into a change position for splicing by a turnstile drive, the old reel and the new reel being mounted on both ends of the turnstile;

accelerating the new reel with the new material web in the change position up to a withdrawal speed of the old material web;

swiveling the turnstile by the turnstile drive in the direction of a splicing position depending upon the position of the adhesive point in a position-controlled manner;

moving an adhesive roller in a direction of a press-on position;

pressing, by the adhesive roller, the old material web onto the new reel with the new material web and, as soon as the adhesive point passes the press-on position, connecting the new material web and the old material web; and cutting the old material web by a cutting knife after a defined overrun when the adhesive point is in contact with the old web running off the old reel and the adhesive roller is situated in the press-on position, wherein positions of a first drive of the new reel, a second drive of the turnstile, a third drive of the adhesive roller and a fourth drive of the cutting knife are controlled depending upon a position of the new reel, wherein the four drives are position-controlled electric motors thereby producing a synchronous operation of the four drives which guarantees incrementally precise placing of the cutting knife or the adhesive roller onto the new reel.

2. A device for connecting-splicing-two material webs that are withdrawn from an old reel and a new reel while both reels are driven, comprising:

a new reel with a new material web;

an old reel with an old material web;

a turnstile having a turnstile drive;

an adhesive roller;

a cutting knife;

wherein the turnstile drive, the adhesive roller and the cutting knife interact in a position-controlled manner such that the turnstile is swiveled in direction of a splicing position by the turnstile drive and the adhesive roller is moved in direction of a press-on position, wherein, when an adhesive point comes into contact with the old material web from the old reel, the adhesive roller is situated in the press-on position, wherein the adhesive roller presses the old material web onto the new reel with the new material web and, as soon as the adhesive point passes the press-on position, connects the new material web and the old material web; and wherein, after a defined overrun, the old material web is cut by the cutting knife, wherein positions of a first drive of the new reel, a second drive of the turnstile, a third drive of the adhesive roller and a fourth drive of the cutting knife are controlled depending upon a position of the new reel, wherein the four drives are position-controlled electric motors thereby producing a synchronous operation of the four drives which guarantees incrementally precise placing of the cutting knife or the adhesive roller onto the new reel.

3. The device as claimed in claim 2, further comprising:

a piecing tacho for determining a diameter of the old reel or the new reel.

4. The device as claimed in claim 3, wherein a determination of a position of the new reel is effected depending upon an adhesive point that is provided on the new reel, the adhesive point being detected by a sensor.

5. The device as claimed in claim 2, wherein a determination of a position of the new reel is effected depending upon an adhesive point that is provided on the new reel, the adhesive point being detected by a sensor.

* * * * *